US005975196A

United States Patent [19]

Gaffaney et al.

[11] Patent Number: 5,975,196

[45] Date of Patent: Nov. 2, 1999

[54] HEAT TRANSFER TUBE

[75] Inventors: Daniel Paul Gaffaney, Chittenango; Steven Joseph Spencer, Liverpool, both of N.Y.; Donald Leman Bennett, Franklin, Ky.; Hannu Tapani Heiskanen, Bowling Green, Ky.; Gerald Lee Riggs, Bowling Green, Ky.; Edward Goeb Rottmann, Bowling Green, Ky.; James Marvin Satterly, Franklin, Ky.

[73] Assignee: Carrier Corporation, Syracuse, N.Y.

[21] Appl. No.: 08/614,789

[22] Filed: Mar. 5, 1996

Related U.S. Application Data

[63] Continuation of application No. 08/287,560, Aug. 8, 1994, abandoned.

[51] Int. Cl.[6] ..... F28F 1/40

[52] U.S. Cl. ..... 165/133; 165/184

[58] Field of Search ..... 165/133, 179, 165/184; 29/890.53, 890.48, 890.049

[56] References Cited

U.S. PATENT DOCUMENTS

| | | | |
|---|---|---|---|
| 3,885,622 | 5/1975 | McLain | 165/179 |
| 4,480,684 | 11/1984 | Onishi et al. | 165/133 X |
| 4,658,892 | 4/1987 | Shinohara et al. | 165/133 |
| 4,733,698 | 3/1988 | Sato | 165/179 X |
| 5,332,034 | 7/1994 | Chiang et al. | 165/184 |
| 5,351,397 | 10/1994 | Angeli | 29/890.053 |

FOREIGN PATENT DOCUMENTS

| | | | |
|---|---|---|---|
| 26394 | 2/1982 | Japan | 165/133 |
| 58092 | 4/1982 | Japan | 165/133 |
| 165875 | 6/1990 | Japan | 165/179 |
| 170797 | 7/1991 | Japan | 165/184 |
| 207995 | 9/1991 | Japan | 165/184 |

*Primary Examiner*—Leonard Leo
*Attorney, Agent, or Firm*—William W. Habelt

[57] ABSTRACT

A heat transfer tube having an internal surface that enhances the heat transfer performance of and also improves the workability of the tube and a method of manufacturing such a tube. The internal surface has a plurality of ribs that extend at an angle to the longitudinal axis of the tube. A pattern of parallel notches, extending at an angle to the ribs, extend through the ribs and into the main inner surface of the tube wall. The tube can be made by rolling embossing the pattern of ribs and notches on to one side of a flat metal strip, then roll forming the strip into a tubular shape with the embossed pattern on the interior of the tubular shape and the edges of the strip forming a longitudinal seam, then joining, preferably by welding, the edges along the longitudinal seam to form a tube. In a preferred embodiment, the notches in the inner surface extend into the weld zone of the tube. The pattern of ribs and notches increase the total internal surface area of the tube and also promote conditions for the flow of refrigerant within the tube that increase heat transfer performance. The notches also serve to inhibit the propagation of splits in the tube wall when the tube is flared.

9 Claims, 4 Drawing Sheets

HEAT TRANSFER TUBE

This application is a Continuation of application Ser. No. 08/287,560 filed Aug. 8, 1994, abandoned.

BACKGROUND OF THE INVENTION

This invention relates generally to tubes used in heat exchangers for transferring heat between a fluid inside the tube and a fluid outside the tube and to a method of manufacturing such tubes. More particularly, the invention relates to a heat transfer tube having an internal surface that is capable of enhancing the heat transfer performance of the tube and offering improved workability when compared to prior art tubes. Such a tube is adapted to use in the heat exchangers of air conditioning, refrigeration (AC&R) or similar systems.

Designers of heat transfer tubes have long recognized that the heat transfer performance of a tube having surface enhancements is superior to a smooth walled tube. A wide variety of surface enhancements have been applied to both internal and external tube surfaces including ribs, fins, coatings and inserts, to name just a few. Common to nearly all enhancement designs is an attempt to increase the heat transfer surface area of the tube. Most designs also attempt to encourage turbulence in the fluid flowing through or over the tube in order to promote fluid mixing and break up the boundary layer at the surface of the tube.

A large percentage of AC&R, as well as engine cooling, heat exchangers are of the plate fin and tube type. In such heat exchangers, the tubes are externally enhanced by use of plate fins affixed to the exterior of the tubes. The heat transfer tubes also frequently have internal heat transfer enhancements in the form of modifications to the interior surface of the tube. One very effective internal surface enhancement in current use is a pattern of ribs extending from the tube inner wall and running parallel or nearly so to the longitudinal axis of the tube. Not only does the tube have good heat transfer performance, it is also relatively easy to manufacture, particularly by a process of roll embossing the enhancement pattern on to one side of a metal strip, then roll forming the strip into a tubular shape and welding the resulting seam.

In a typical plate fin and tube type heat exchanger, there are many tubing joints. These joints are usually made by enlarging the end of a first tube so that the inner diameter of the enlarged section is slightly larger than the original outer diameter of the tube. Then the end of a second tube is inserted into the enlarged section of the first tube and the two tubes are joined by a process such as brazing, welding or soldering.

The usual method of enlarging a tube end is by mechanical means such as inserting a belling or flaring tool into the tube. The enlarging process imposes stresses in the tube wall. These stresses can cause the tube wall to split, particularly if the tube is made of a relatively soft metal such as copper or an alloy of copper as is generally the case with the tubing used in AC&R heat exchangers. A tube having an enlarged end that has serious splits must be scrapped. The splitting problem is especially pronounced in tubing having the longitudinal ribs described above.

SUMMARY OF THE INVENTION

The heat transfer tube of the present invention has an internal surface that is configured to enhance the heat transfer performance of the tube. The internal enhancement is a ribbed internal surface. A pattern of parallel notches is impressed at an angle into and through the ribs and into the inner wall of the tube so that the tube inner wall between the ribs is also notched. The enhanced surface increases the internal surface area of the tube thus increasing the heat transfer performance of the tube. The enhanced surface also promotes flow conditions within the tube that increase the heat transfer performance of the tube. The notches also serve to inhibit the propagation of splits in the tube wall and thus improve the ability of the tube to be enlarged.

The present invention also includes a method of manufacturing of the tube by roll embossing the enhanced surface on one side of a copper or copper alloy strip. The strip is then roll formed and seam welded into a tube having the enhanced surface on the interior of the tube. Such a manufacturing process is capable of rapidly and economically producing tubing.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
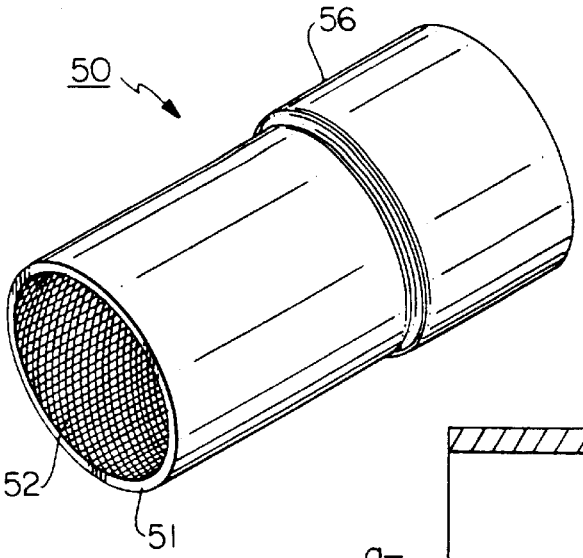
FIG. 1 is a pictorial view of the heat transfer tube of the present invention.

FIG. 1 shows, in an overall isometric view, the heat transfer tube of the present invention. Tube 50 has tube wall 51 upon which is formed internal surface enhancement 52. Enlarged section 56 of tube 50 is formed in the tube so that a second tube of the same diameter as tube 50 may be inserted in the enlarged section to form a joint.

Figure 2:
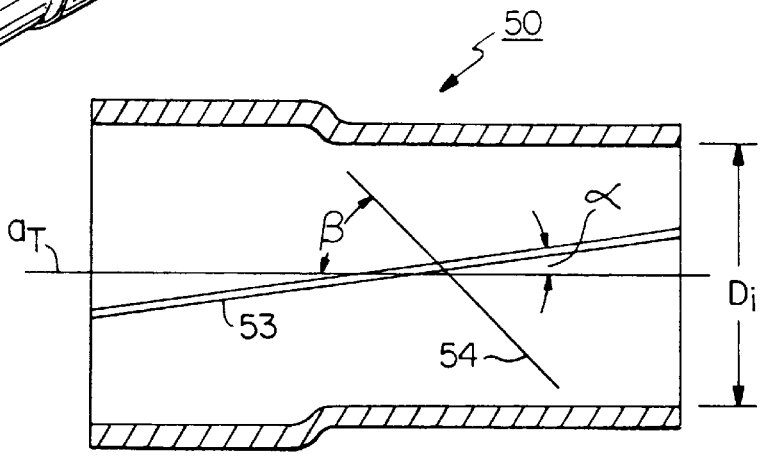
FIG. 2 is a sectioned illustrative view of the heat transfer tube of the present invention taken along the axis of the tube of FIG. 1.

FIG. 2 depicts heat transfer tube 50 in a cross sectioned elevation view. Only a single rib 53 and a single notch (depicted by line 54) of surface enhancement 52 (FIG. 1) are shown in FIG. 2 for clarity, but in the tube of the present invention, a plurality of ribs 53, all parallel to each other, extend out from wall 51 of tube 50. In this FIG. 2 the rib 53 is inclined at angle $\alpha$ from tube longitudinal axis $a_T$, which angle could be 0° or as great as 35°, as explained hereinafter. If other than 0°, the ribs 53 would be helical ribs. Notch 54 extends into and through rib 53 and also into wall 51. Notch 54 is inclined at angle β from tube longitudinal axis $a_T$. Tube 50 has internal diameter $D_i$, as measured from the internal surface of the tube between ribs, $D_i$ (i.e. excluding the ribs 53).

Figure 3:
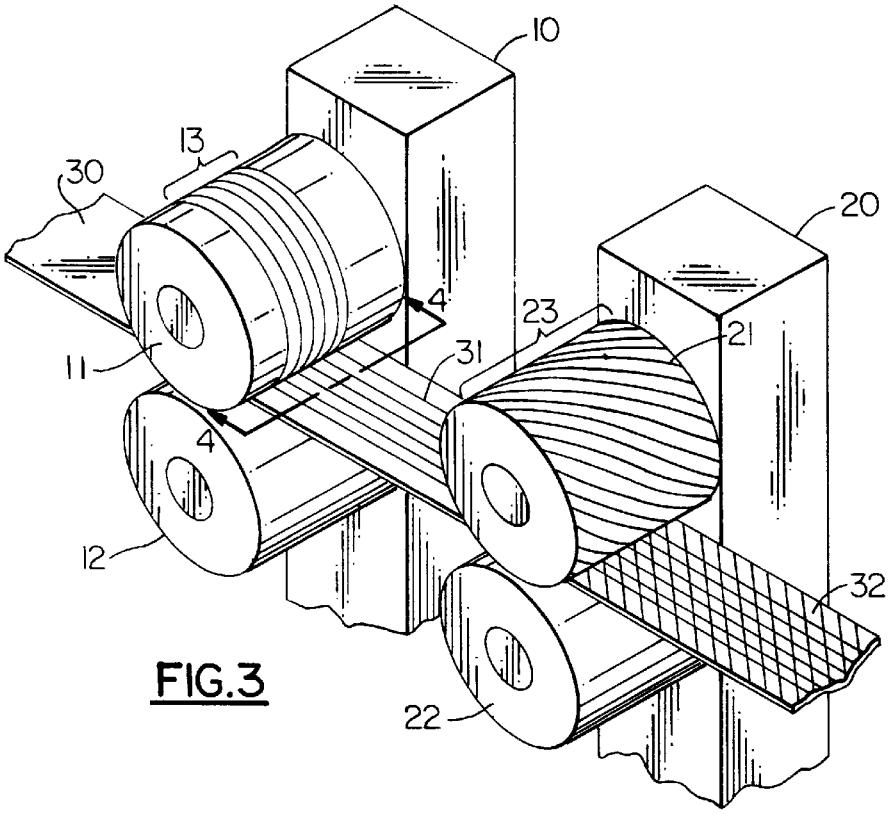
FIG. 3 is a schematic view of the method of manufacturing the heat transfer tube of the present invention.

FIG. 3 depicts schematically the method of manufacture of the present invention. In the method, enhancement 52 is formed on one surface of a metal strip by roll embossing before the strip is roll formed into a circular cross section and seam welded into a tube. Two roll embossing stations, respectively 10 and 20, are positioned in the production line between the source of supply of unworked metal strip and the portion of the production line where the strip is roll formed into a tubular shape. Each embossing station has a patterned enhancement roller, respectively 11 and 21, and a backing roller, respectively 12 and 22. The backing and patterned rollers in each station are pressed together with sufficient force, by suitable means (not shown), to cause surface 13 on roller 11 to be impressed into the surface of one side of strip 30, thus forming enhancement pattern 31 on the strip, which in this embodiment are ribs 53 parallel to the edges of the strip 30 and to each other. Patterned surface 13 is the mirror image of the ribbed portion of the surface enhancement in the finished tube. Patterned surface 23 on roller 21 has a series of raised projections that press into enhancement pattern 31 and form the notches 54 in the finished tube.

Figure 4:
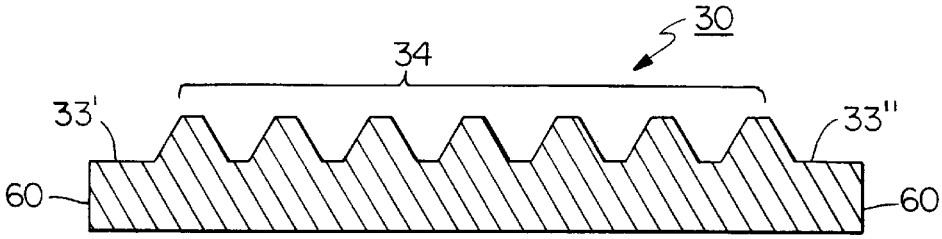
FIG. 4 is an illustrative sectioned view taken along the 4—4 of FIG. 3.
Figure 5:
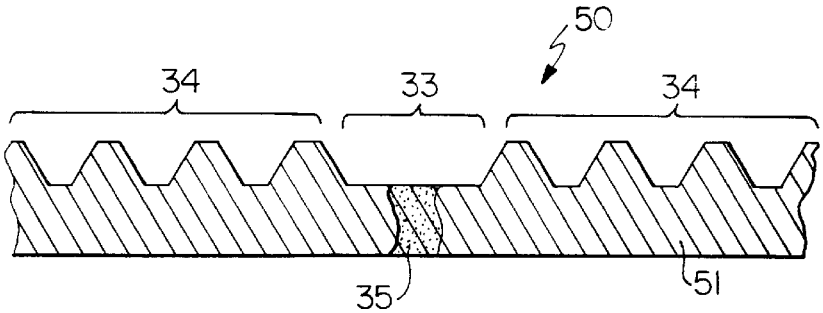
FIG. 5 is an illustrative sectioned view of a section of the wall of the heat transfer tube taken perpendicular to the tube axis through the weld seam.
Figure 7:
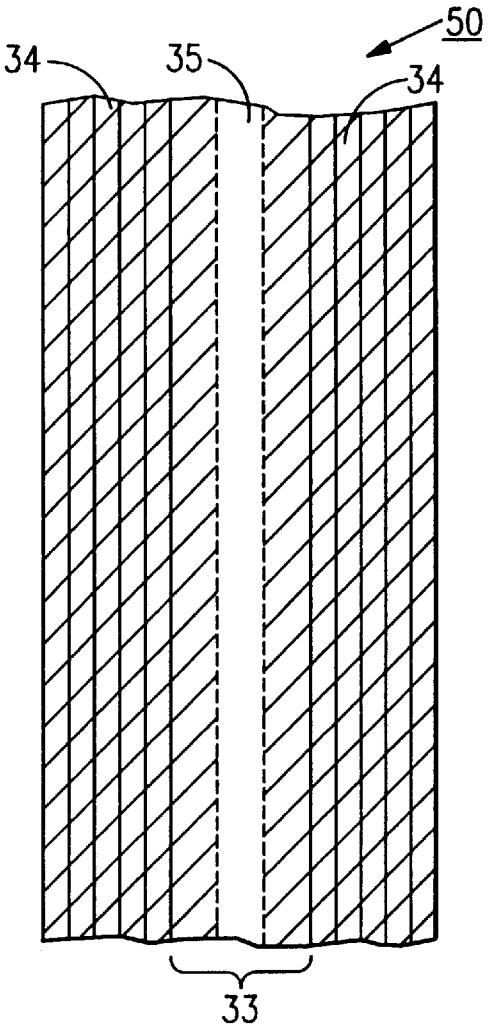
FIG. 7 is an illustrative plan view of a section of the wall of a heat transfer tube.
Figure 6:
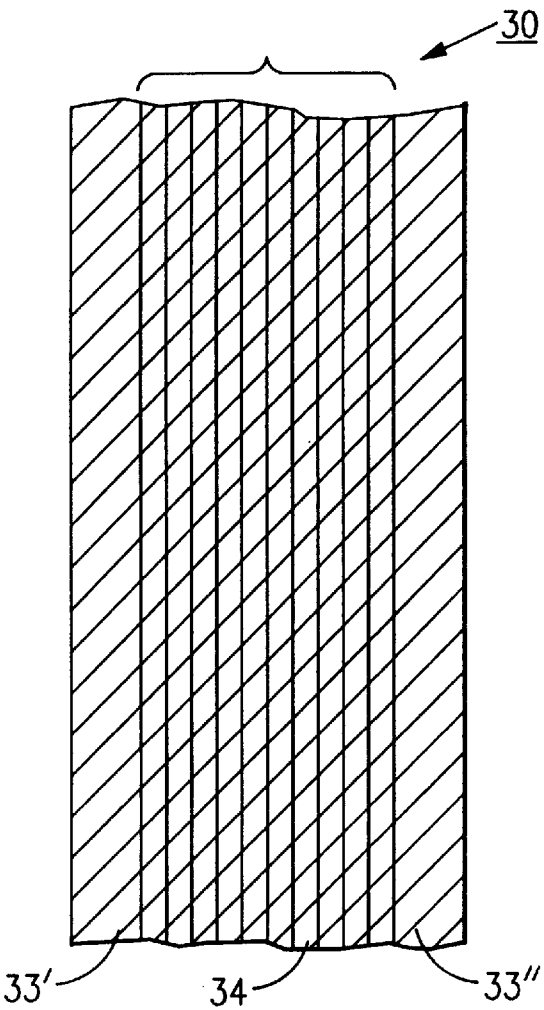
FIG. 6 is an illustrative plan view of a metal strip having a surface enhancement in accordance with the present invention.

Enhancement pattern 31 (i.e. the ribs 53) does not extend to the edges of strip 30 but the notches formed by patterned surface 23 do extend to the strip edges 60. FIGS. 4 and 6 and FIGS. 5 and 7, respectively illustrate what happens when the enhanced strip is roll formed and seam welded into a tube. As shown in FIG. 4 at one edge of strip 30 is weld zone 33' and at the other is weld zone 33". The notches (not shown in either FIGS. 4 or 5 for clarity) formed by patterned surface 23 (FIG. 3) extend over the entire width of the strip including weld zones 33' and 33". After roll forming and seam welding, strip 30 becomes tube 50. FIG. 5 is a sectioned view and FIG. 7 is a plan view of tube 50 if it were cut longitudinally along a line diametrically opposite the seam weld and then flattened out. Tube 50 has single weld zone 33 with weld bead 35 running through it. The welding process fuses and deforms the metal in strip 30/tube 50 so that there are no notches in weld bead 35 but there are notches in that portion of weld zone 33 that was not fused during the welding process.

Figure 8:
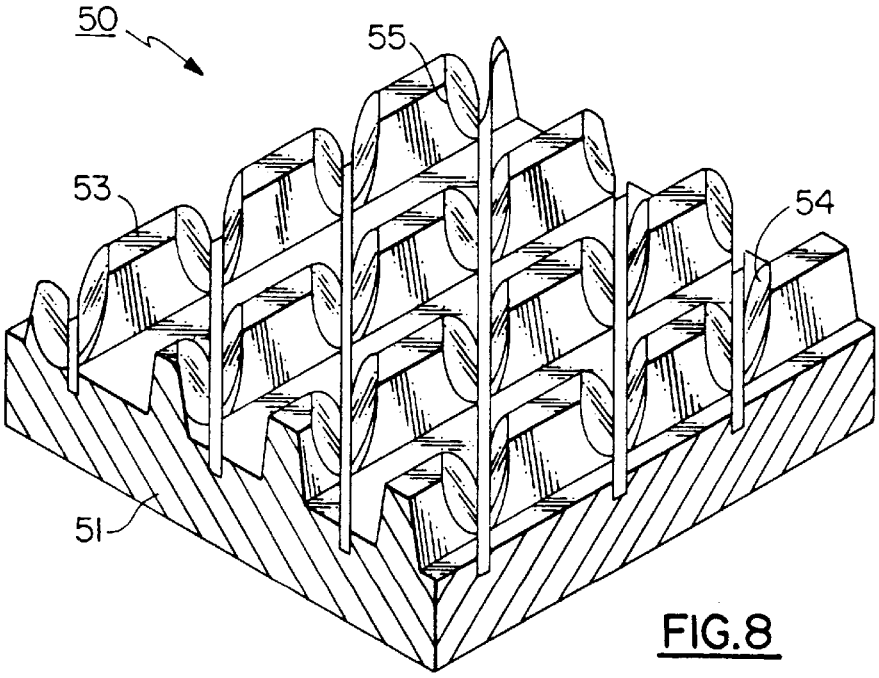
FIG. 8 is an isometric view of a section of the wall of the heat transfer tube of the present invention.

FIG. 8 is an isometric view of a portion of wall 51 of heat transfer tube 50 depicting details of surface enhancement 52. Extending outward from wall 51 are a plurality of ribs 53. At intervals along the ribs and extending into wall 51 are a series of notches 54. The material displaced as the notches are formed in the ribs is left as projections 55 that project outward from each side of a given rib 53 around each notch 54 in that rib. The projections have a salutary effect on the heat transfer performance of the tube, as they both increase the surface area of the tube exposed to the fluid flowing through the tube and also promote turbulence in the fluid flow near the tube inner surface.

Figure 9:
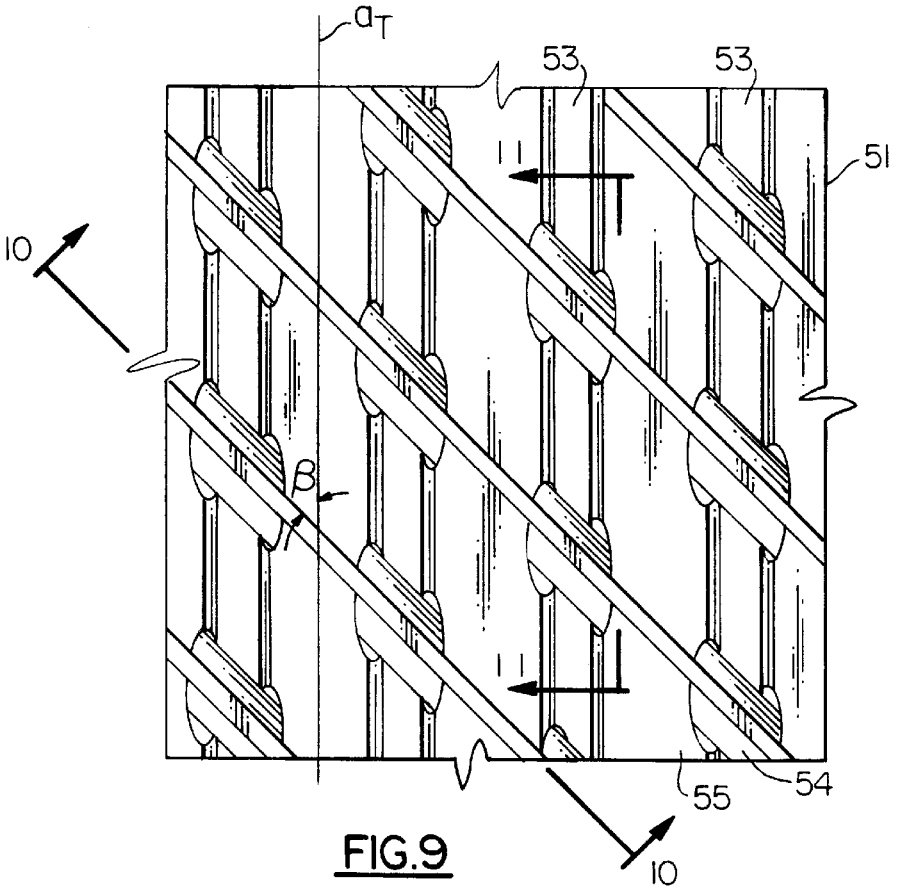
FIG. 9 is a plan view of a section of the of the wall of the heat transfer tube of the present invention.

FIG. 9 is a plan view of a portion of wall 51 of tube 50. The figure shows ribs 53 disposed on the wall with notches 54 impressed into the ribs and wall 51. The angle between the notches and tube longitudinal axis is angle β.

Figure 10:
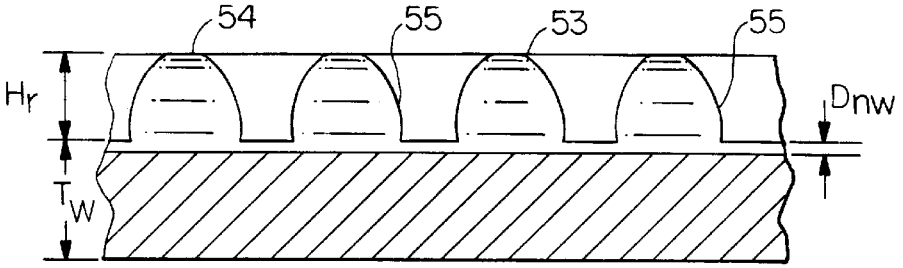
FIG. 10 is a section view of the wall of the heat transfer tube of the present invention taken through line 10—10 in FIG. 9.

FIG. 10 is a section view of wall 51 taken through line 10—10 in FIG. 9. The figure shows that ribs 53 have height $H_r$, that wall 51 has thickness, excluding the ribs, $T_w$ and that the notch pattern extends to depth $D_{nw}$ into wall 51.

Figure 11:
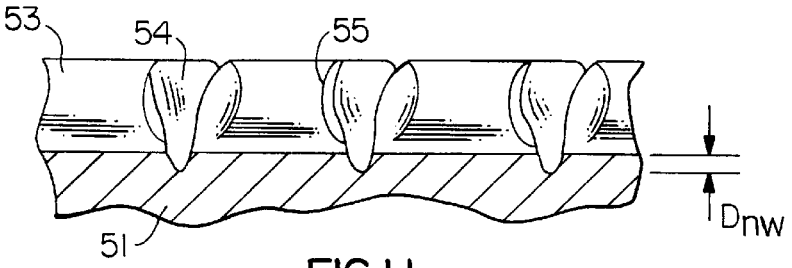
FIG. 11 is a section view of the wall of the heat transfer tube of the present invention taken through line 11—11 in FIG. 9.

FIG. 11 is a section view of wall 51 taken through line 11—11 in FIG. 9. The figure shows that notches 54 are impressed through ribs 54 and into wall to depth $D_{nw}$.

For optimum heat transfer consistent with minimum fluid flow resistance, a tube embodying the present invention and having a nominal outside diameter of 16 mm (⅝ inch) or less should have an internal enhancement with features as described above and having the following parameters:

a. the angle between the ribs and the longitudinal axis of the tube (the helix angle α) should be between zero degrees, i.e., substantially parallel to the tube axis and 35 degrees, or $$0°<\alpha<35°;$$

b. the angle of incidence between the notch axis and the longitudinal axis of the tube should be between 15 and 90 degrees; or $$15°<\beta 90<°;$$

c. the ratio of the rib height to the inner diameter of the tube should be between 0.010 and 0.050, or $$0.010<H_r/D_i<0.050;$$

and d. the notches should penetrate completely through the ribs and into the main portion of the tube wall; the depth of penetration of the notches into the tube wall should be less than 30 percent of the wall thickness, or $$D_{nw}/T_w<0.30.$$

We claim:

1. A heat transfer tube comprising a wall and having a longitudinal axis, said wall including a longitudinally extending weld bead parallel to said axis and extending for the length of said tube, said tube including a weld zone along its length, said zone including said weld bead and extending outwardly on both sides of said weld bead, said tube wall having an inner surface, a plurality of axially extending spaced apart ribs formed in said surface, said ribs having a height $H_r$, said weld zone being free from said ribs, a plurality of notches formed in said inner surface at an angle β to said ribs, said notches passing through said ribs to a depth greater than said rib height and extending into said weld zone.

2. The heat transfer tube according to claim 1 wherein said ribs are helical ribs and said notches are helical notches.

3. The heat transfer tube according to claim 2, wherein said weld bead is free from said notches.

4. The heat transfer tube according to claim 3 wherein the rib helix angle is 35° or less.

5. The heat transfer tube according to claim 1 wherein the angle β is between 15 and 90 degrees, said ribs are helical, the rib helix angle is 35° or less, and said weld bead is free from said notches.

6. The heat transfer tube according to claim 5, wherein said inner wall surface diameter as measured from said wall surface between said ribs is $D_i$, and the ratio of the rib height $H_r$ to the diameter $D_i$ is between 0.010 and 0.050.

7. The heat transfer tube according to claim 6, wherein said tube wall thickness between said ribs is $T_w$, and said notches penetrate into said tube wall in the area between said ribs less than 30 percent of $T_w$.

8. The heat transfer tube according to claim 1 wherein said tube has at least one end which has been enlarged.

9. The heat transfer tube according to claim 1, wherein each of said ribs includes rib material projecting laterally from said ribs into the space between adjacent ribs at the intersections of said ribs and notches.

* * * * *